US007282869B1

(12) United States Patent
Mayer et al.

(10) Patent No.: US 7,282,869 B1
(45) Date of Patent: Oct. 16, 2007

(54) HID BALLAST AND LAMP TESTER

(75) Inventors: Thomas Mayer, Wisconsin Dells, WI (US); Glenn Garbowicz, Algonquin, IL (US)

(73) Assignee: Varon Lighting Group, LLC, Elmhurst, IL (US)

( * ) Notice: Subject to any disclaimer, the term of this patent is extended or adjusted under 35 U.S.C. 154(b) by 0 days.

(21) Appl. No.: 11/363,362

(22) Filed: Feb. 27, 2006

(51) Int. Cl.
*H05B 41/14* (2006.01)

(52) U.S. Cl. ..... 315/290; 315/135; 315/289; 315/243; 315/246; 315/DIG. 5

(58) Field of Classification Search ..... 315/135, 315/136, 227 R, 200 R, 200 A, 243, 276, 315/289, 290, DIG. 5; 324/403, 414
See application file for complete search history.

(56) References Cited

U.S. PATENT DOCUMENTS 3,771,014 A * 11/1973 Paget ..... 315/136
4,318,031 A 3/1982 Lonseth et al.
5,321,338 A * 6/1994 Nuckolls et al. ..... 315/290
5,323,116 A * 6/1994 Atria ..... 324/511
6,127,782 A * 10/2000 Flory et al. ..... 315/129
6,429,597 B1 * 8/2002 Flory et al. ..... 315/129

* cited by examiner

*Primary Examiner*—Haissa Philogene
(74) *Attorney, Agent, or Firm*—Levenfeld Pearlstein, LLC

(57) ABSTRACT

The instant invention relates to an HID ballast and lamp tester, which provides visual indication of failure of either the ballast or lamp by continuously monitoring the status of the HID lighting system. The HID ballast and lamp tester detects and utilizes the voltage difference between the open circuit voltage and the operating voltage of the ballast to trigger visual indication of the open circuit voltage output of the ballast when the HID lamp has failed. The tester circuit comprises the ballast source, a full wave bridge rectifier and filter capacitor circuit, a voltage divider network circuit, a trigger circuit of a diac bi-directional silicon switch and a light emitting diode.

4 Claims, 2 Drawing Sheets

FIG. 4a STANDARD METAL HALIDE BALLASTS - 175W-400W
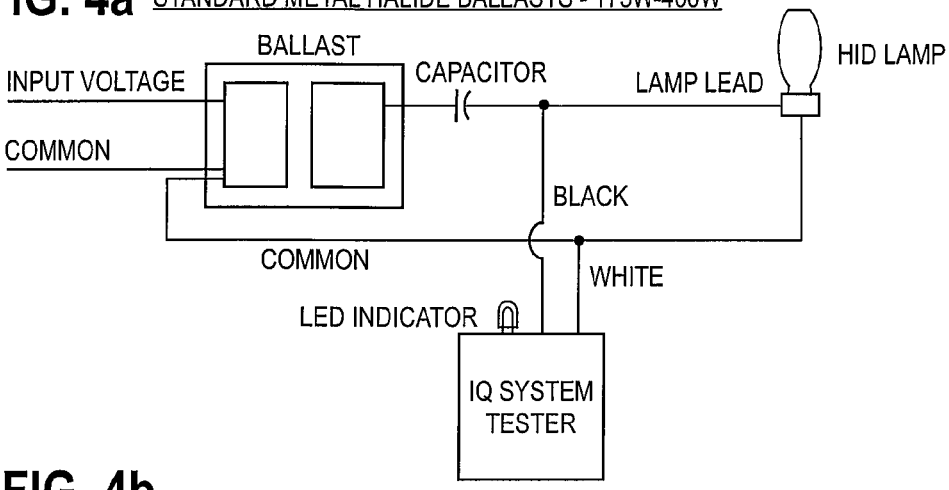
FIG. 4b
PULSE START METAL HALIDE BALLASTS 50-450W AND 250-400W HPS
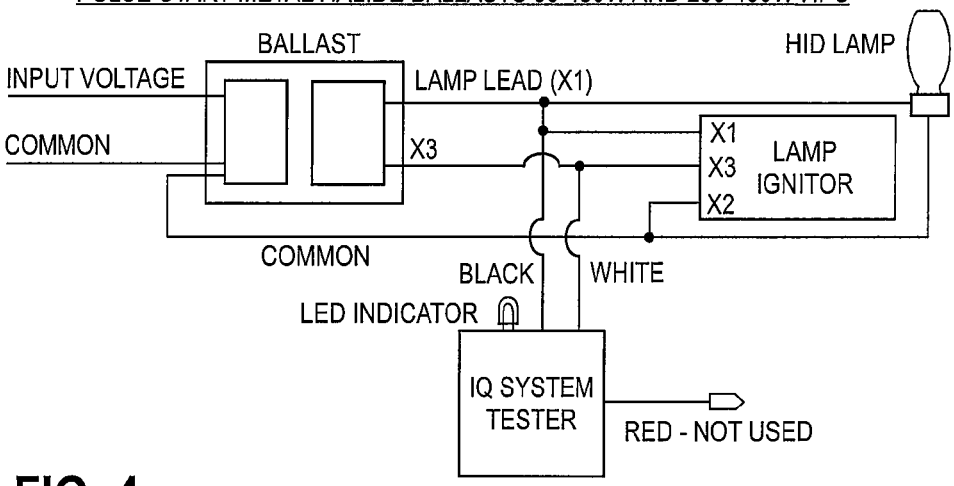
FIG. 4c
HIGH PRESSURE SODIUM - 50-150W HPS
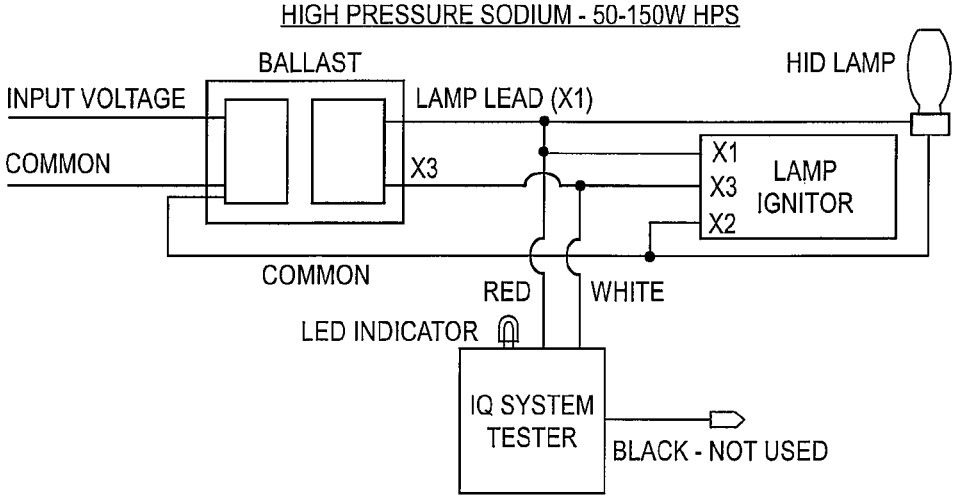

HID BALLAST AND LAMP TESTER

FIELD OF THE INVENTION

The invention relates generally to a high intensity discharge (HID) lamp and HID ballast tester particularly for standard metal halide ballasts of 175–400 W, pulse start metal halide ballasts of 50–450 W and high pressure sodium ballasts (HPS) of 50–400 W. The HID ballast and HID lamp tester continuously monitor the status of the HID lighting system of the ballast and HID lamp and provide a visual, continuous indication of the operating condition of the HID ballast and HID lamp. When the LED of the tester flashes when the lamp is out, the HID lamp has failed. When the LED of the tester does not flash when the lamp is out, the ballast or igniter or both have failed.

BACKGROUND OF THE INVENTION

High intensity discharge (HID) lamps are used in many applications because of their long life and high efficiency. Principal types of HID lamps are high pressure sodium (HPS), pulse start metal halide (PSMH), and mercury vapor lamps.

Mercury vapor, metal halide, and HPS lamps all operate similarly during stabilized lamp operations. The visible light output results from the ionization of gases confined within an envelope and which must be broken down before there is any flow of ionization current. Accordingly, a high open circuit voltage must be applied to an HID lamp for igniting. This voltage is substantially higher than the operating voltage and the available line voltage.

HID lamps also exhibit negative resistance. When operating, their resistance decreases with increase in the applied voltage. As a result, such lamps require an impedance means in their power supply to limit the alternating current flow to a predetermined value.

Because of the high starting or igniting voltage requirement and the negative resistance characteristic, HID lamps are provided with igniting and operating circuits, which provide a relatively high open circuit voltage and impedance means for current limitations. A ballast between the power supply and lamp typically serves as its impedance means in igniting and operating circuits for HID lamps. For HID lamps such as mercury vapor lamps, igniting voltages can be two times the operating voltage. The igniting voltage is generated by the ballast secondary coil winding. For high pressure sodium (HPS) lamps, the required voltages can be more than ten times the operating voltages and more complex igniting mechanisms are employed.

The ballast system also typically provides for certain requirements when electronic igniters are used in conjunction with the HID lamps. For example, electronic igniters used in conjunction with high pressure sodium (HPS) ballast coils produce a high voltage pulse to start the HPS lamp. These electronic igniters work by sensing whether the lamp is burning or not. If the lamp is not burning, the igniter continuously supplies starting pulses to the lamp, regardless of whether the lamp is not burning because of lamp failure, absence of a lamp in the lamp socket, or by the lamp "cycling off."

Lamp cycling is a well-known phenomenon in which a lamp nearing the end of its life will light, turn on for some time, go out, relight, and repeat this cycle time after time until the lamp is replaced or the lamp will fail to start at all. In an HPS lamp, as the HPS lamp nears the end of its life, its lamp operating voltage gets so high that the ballast will no longer sustain operation, and the lamp cycling condition manifests itself.

From the foregoing, it is clear that certain problems can arise in the operation of HID lamps and associated ballasts. In certain situations, e.g., when a lamp is cycling, failed or is missing, the igniter in the lamp's HID circuit continues to operate. Such operation shortens igniter and ballast life due to the presence of continuous high voltage pulses that inflict unusual, extended stress on the lighting system. The result of this stress on the ballast transformer may result in burning or smoking, damaged HID lamp fixtures, and wiring. Cycling lamps can be also avoid replacement by being "on" when inspected and thus cause future maintenance problems.

High intensity discharge (HID) lamps are used in roadway lighting, manufacturing installations with high/inaccessible ceilings, military installations, aircraft hangars, parking lots, tennis courts, athletic arenas and the like. Replacement of a failed lamp installation can be time-consuming and require specialized access equipment not always immediately available. Maintenance and operational inspections can be infrequent. Frequently, replacement of the lamp of a failed lamp installation is the first step. If the lamp is not the cause of the lamp outage, the cause can be a failed igniter or failed ballast or both. The cause may not be determined until the failed element is replaced and operating power is applied.

The ability to make an operating/problem diagnosis from the ground without access to the lamp installation overhead is an advantage. To determine the cause of the failed lamp installation to order the requisite replacement components and to schedule the repair in a manner that minimizes disruption to the facility where the HID lamp is located is a further advantage provided by the instant invention in the maintenance and repair of failed HID lamp installations.

In the prior art, U.S. Pat. No. 4,318,031 teaches a visual monitor including a single light indicator for HID lamps not needing a starter and a visual monitor including two light indicators for an HID lamp operating in conjunction with the starter. When the lamp is out, the presence or non-presence of an ignited first light indicator indicates lamp failure or ballast failure, respectively. The blinking or non-blinking of the second light indicator indicates whether or not the starter is producing satisfactory starting pulses. Power source is 60 Hz line voltage.

The visual monitor of U.S. Pat. No. 4,318,031 for an HID lamp and ballast includes a second indicator light circuit connected to the starter having a storage capacitor, a diode connected to said capacitor and conductive at a predetermined voltage and an indicator light connected to said capacitor, wherein when the lamp is not lit, the operating starter producing pulses of short duration of predetermined amplitude causes conduction of said diode and storage on said capacitor. A plurality of pulses causes capacitor discharge through said indicator light to cause periodic blinking thereof, the absence of periodic blinking when the lamp is not lit indicating a starter failure.

The visual monitor of U.S. Pat. No. 4,318,031 for a light fixture includes a lamp and a ballast and a starter, said monitor comprising a first indicator light circuit connected in parallel with the lamp and including a first indicator light and the second indicator light connected to the starter wherein absence of ignition of the first indicator light with absence of the lamp being lit indicates ballast failure.

Accordingly, in the prior art it is known to provide visual indicators connected to an HID lamp's ballast and starter to indicate which of the two components of the HID lamp's circuitry, either the ballast or the starter, has failed when the monitored lamp is extinguished. However, the visual device of the instant invention permits rapid identification of failed, broken or missing HID lamps in virtually all applications using HID (high pressure sodium and metal halide) lamps and ballasts equipped with pulse type igniters. A flashing LED signifies a failed lamp, whereas a non-flashing LED signifies a failed ballast or igniter or both.

SUMMARY OF THE INVENTION

This invention relates to a high intensity discharge (HID) ballast and lamp tester, which provides a flashing signal via a light emitting diode (LED) to indicate ballast or lamp failure. The invented tester connects to the output side of the ballast and does not require a specific input voltage. The tester continuously monitors the status of the HID lighting system and provides a visual indicator for troubleshooting purposes. The HID ballast and lamp tester utilizes the voltage difference between the open circuit voltage and the output voltage of the ballast to trigger visual indication of the open circuit voltage when the lamp has failed and failure of the ballast or igniter when no visual indication is provided. The ballast and lamp tester comprise four basis components: (a) an alternating current voltage divider resistor load, (b) a direct current bridge rectifier circuit to provide a regulated direct current voltage to components of the ballast and lamp tester, (c) a trigger circuit comprising a diac bi-directional silicon switch which is triggered when its breakover voltage is exceeded, and (d) a display circuit comprising a light emitting diode (LED) which emits light when triggered by a voltage output from the trigger circuit comprising a diac.

In operation, upon application of an activating alternating current supplied from the output side of the ballast, the voltage divider current and the input leads of the direct current rectifier circuit comprise a rectifier bridge of four rectifier diodes and filter capacitor C1. The DC voltage across C1 comprises a regulated voltage level basis the current limiting resistor which causes the trigger circuit diac to conduct to activate the display circuit LED upon failure of the lamp to illuminate, based on the voltage differences between the resulting open circuit voltage and the operating voltage of the ballast when the lamp is illuminated.

In the event of a failed, broken or missing HID lamp, voltages present at the input leads of the ballast and lamp tester are reduced by dropping and load resistors and are imposed upon the direct current rectifier circuit. The trigger circuit causes the display circuit to be activated to cause the LED to flash, indicating a failed, broken or missing lamp. If the lamp is out and the LED fails to flash, the failure of the LED to flash indicates the ballast or igniter has failed or both the ballast and igniter have failed.

DESCRIPTION OF THE DRAWINGS

FIG. 4 illustrates three wiring diagrams of application of two embodiments of the invention wherein one wiring diagram illustrates a first embodiment not requiring an igniter (FIG. 4*a*), and two wiring diagrams illustrate a second embodiment requiring an igniter (FIG. 4*b* and FIG. 4*c*).

DETAILS OF THE INVENTION

Figure 1:
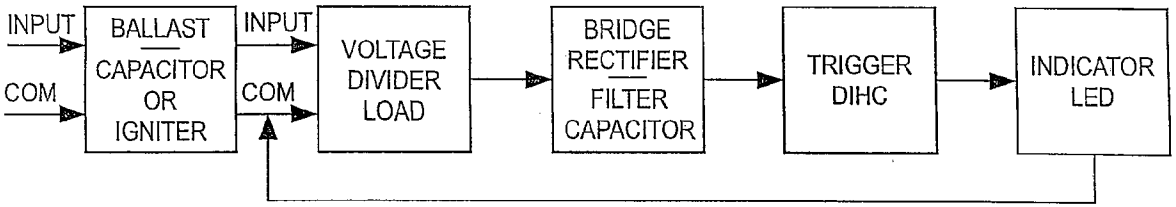
FIG. 1 is a simplified black diagram of the HID ballast and lamp tester showing sub-portions of the circuitry.

FIG. 1 illustrates the components of the instant invention including a ballast and ballast circuitry of a capacitor or igniter for providing an output of relatively high amplitude open circuit voltage as a series of high voltage pulses to an HID lamp and lower operating voltage to the HID lamp as a pulse AC power source and as an operating voltage source.

FIG. 1 illustrates the operating components of the instant invention comprising the voltage divider resistor load, the bridge rectifier and filter capacitor to smooth the output of the bridge rectifier, the trigger component comprising a diac and the LED indicator.

In the instant invention, the first embodiment (FIG. 2 and FIG. 4*a*) is provided for operation in conjunction with an HID lamp not requiring an igniter. The wiring diagram accordingly comprises a ballast, a storage capacitor to initiate an igniting pulse, the HID lamp and lamp tester. If the lamp is out and the LED flashes, the visual indicator signals that the lamp has failed, is broken or is missing. If the lamp is out and the LED does not flash, the visual indicator signals that the ballast or igniter has failed and is the source of the lamp not being illuminated. The first embodiment is suitable for operation in conjunction with standard metal halide ballast of 175–400 W, not requiring a starter for operation.

Figure 2:
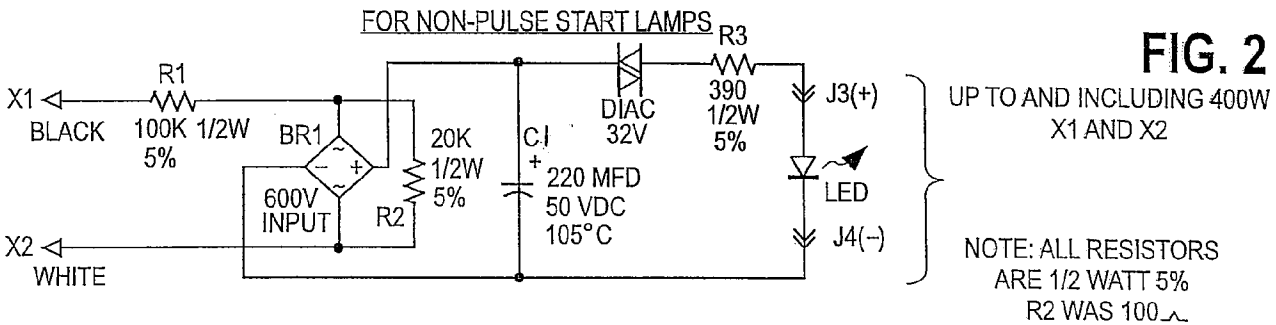
FIG. 2 is a schematic diagram of a visual monitor of a first embodiment of the invention operating in conjunction with a charging capacitor and an HID lamp not requiring an igniter.

Referring to FIG. 2, the voltages present for a non-igniter start lamp are at two tap leads, X1 and X2. When voltage is initially applied to the lamp fixture, high voltage pulses are generated across ballast lead wires X1 and X2 and imposed across the lamp.

During this start cycle, a small fraction of this open circuit voltage is introduced by the voltage divider circuit across the input to the BRI, the output of the BR1 serving to store a DC voltage in capacitor C1. As the relatively high amplitude open circuit of the ballast continues, the output of the BR1 continues to provide a DC voltage capacitor C1 until the stored voltage level of capacitor C1 reaches the breakdown voltage of 32 volt diac. At this level, the 32 volt diac switch conducts. The LED momentarily flashes to indicate the relatively high amplitude open circuit voltage of the ballast present. The process continues, the LED continuing to flash to indicate the presence of the high amplitude open circuit voltage of the ballast, thus indicating a lamp failure and an operating ballast.

In operation of the first embodiment (FIG. 2) of the present invention with non-igniter start type lamps and ballasts, input voltage levels are detected at terminals X1 and X2. Terminals X1 and X2 represent the ballast secondary output or open circuit voltage.

During normal fixture operation, voltages present at taps X1 and X2 are seen by rectifier bridge BR1, consisting of four rectifier diodes and filter capacitor C1 and are insufficient to overcome the breakdown voltage of a 32 volt diac bi-directional silicon switch, preventing illumination of light emitting diode (LED) at terminals J3 and J4. The ballast open circuit voltage is measured through voltage divider consisting of R1 and R2.

In the event of a failed, broken or missing lamp, voltages present at taps X1 and X2 are appropriately reduced by dropping resistor R1 and load resistor R2 and imposed upon rectifier bridge BR1 and filter capacitor C1. Under failed lamp conditions, the ballast open circuit voltage rises across these components to a level sufficient to force 32 volt diac into conduction, discharging the voltage stored in capacitor C1 across the LED via the diac and current limiting resistor R3. During this process, capacitor C1 discharges to a point where the diac returns to a non-conductive state as the current flow to the LED falls below the diac's ability to remain in conduction, or in holding current condition. The LED is briefly extinguished while capacitor C1 again charges to a level sufficient to again force the diac to conduction.

The wiring diagram in FIG. 4*a* illustrates the embodiment of FIG. 2 for a standard metal halide ballast of 175 W–400 W not requiring an igniter illustrates a capacitor in series connection with to the lamp using secondary ballast voltage to start and re-ignite the lamp in the event of a failed, broken or missing lamp. The open circuit ballast voltage rises under the failed lamp condition over the operating circuit voltage when the lamp is illuminated to a level sufficient to cause the 32 volt diac to conduct and the LED to flash. This repetitive process causes the LED to flash or strobe, indicating a failed, broken or missing lamp.

In the instant invention, the second embodiment (FIG. 3 and FIGS. 4*b* and 4*c*) is provided for operation in conjunction with ballasts requiring an igniter. The wiring diagrams illustrate that voltages present at input leads X1*a* and X1*b* are selected based on lamp wattage and lamp type as determined, for example, by whether the pulse start metal halide ballasts are 50–450 W and 250–400 W HPS, or 50–150 W HPS.

Figure 3:
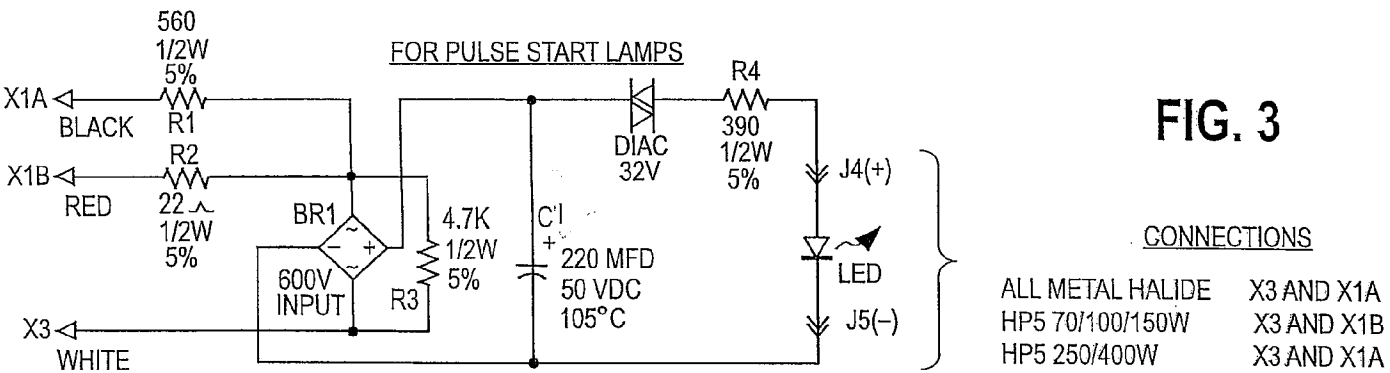
FIG. 3 is a schematic diagram of a visual monitor of a second embodiment of the invention operating in conjunction with an HID lamp requiring an igniter.

The wiring diagram in FIG. 4*b* illustrates the embodiment of FIG. 3 for igniter start metal halide ballasts of 50–450 W and 250–400 W HPS requiring an igniter in parallel connection with the lamp illustrates provision of an igniter to apply a series of high voltage pulses to the lamp to ignite and re-ignite the lamp in the event of a failed, broken or missing lamp. The open circuit ballast voltage rises under the failed lamp condition to a level sufficient to cause the 32 volt diac to conduct and the LED to flash.

The wiring diagram in FIG. 4*c* illustrates the embodiment of FIG. 3 for an igniter start ballast for 50–150 W HPS requiring an igniter and illustrates provision of an igniter to apply a series of high voltage pulses to the lamp to ignite and re-ignite the lamp and to cause the 32 volt diac to conduct and the LED to flash as in the above ballast application in FIG. 4*b*.

In operation of the second embodiment, as illustrated in FIGS. 4*b* and 4*c*, with igniter start type lamps and ballasts requiring an igniter input, voltages are detected via terminals X1*a*, X1*b* and X3. X3 represents the pulse winding tap for metal halide and HPS ballasts. X1*a* and X1*b* taps are selected based on lamp wattage and lamp type.

During normal operation with igniter start type lamps and ballasts, voltages present at tap X3 and either tap X1*a* or X1*b* (based on fixture type and wattage) are seen by rectifier bridge BR1 (consisting of four rectifier diodes) and filter capacitor C1, and are insufficient to overcome the breakdown voltage of a 32 volt diac bi-directional silicon switch, preventing illumination of the light emitting diode (LED) at terminals J4 and J5.

Lamp wattages and types can be selected by selection of the proper voltage divider network consisting of series resistors R1 and R2 and load resistor R3.

In operation of the second embodiment of the present invention with igniter start type lamps and ballasts, in the event of failed, broken or missing lamp, voltages present at tap X3 and either tap X1*a* or X1*b* are appropriately reduced by resistor R1 or R2 and load resistor R3 and imposed upon rectifier bridge BR1 and filter capacitor C1. During proper igniter operation, the voltage across C1 rises to a level sufficient to force 32 volt diac into conduction, discharging the voltage stored in C1 across the LED via the diac and current limiting resistor R4. During this process, capacitor C1 discharges to a point where the diac returns to a non-conductive state, as the current flow to the LED falls below the diac's ability to remain in conduction, or holding current condition. The LED is briefly extinguished while capacitor C1 again charges to a level sufficient to again force the diac into conduction. This repetitive process causes the LED to flash or strobe, indicating a failed, broken or missing lamp.

Exemplary components of the first embodiment for a non-igniter start of lamps and ballasts of the instant invention are:

| | |
|---|---|
| R1 | 100K ohm ½ W 5% resistor |
| R2 | 20K ohm ½ W 5% resistor |
| R3 | 390K ohm ½ W 5% resistor |
| C1 | 220 mfd/50 vdc 105 C capacitor |
| BR1 | IN4007 Diode ^ 4 pcs |
| DIAC | 32 volt HT-32 or equiv. |
| LED | High Output/High Efficiency |
| J3/J4 | LED lead termination |

Exemplary components of the second embodiment for igniter start type lamps and ballasts of the instant invention are:

| | |
|---|---|
| R1 | 560K ohm ½ W 5% resistor |
| R2 | 22K ohm ½ W 5% resistor |
| R3 | 4.75K ohm ½ W 5% resistor |
| R4 | 390K ohm ½ W 5% resistor |
| C1 | 220 mfd/50 vdc 105 C capacitor |
| BR1 | IN4007 diode × 4 pcs |
| DIAC | 32 volt HT-32 or equiv. |
| LED | High Output/High Efficiency |
| J4/J5 | LED lead termination |

In further detail, operation of the instant invention to test operation of an HID ballast and HID lamp is by operating circuitry characteristics of the HID ballast. Typically, the operating output voltage of any HID ballast is at least one-half its open circuit voltage of a charging capacitor or igniter.

The instant invention operating circuit detects and utilizes the voltage difference between the relatively high amplitude open circuit voltage of the ballast and accompanying igniter, when used, and the lower operating voltage of the HID lamp. The voltage difference between the open circuit voltage of the ballast is utilized to initiate the breakdown voltage of the 32 volt diac bi-directional silicon switch to cause the illumination of its light emitting diode (LED).

Referring to FIG. 3 of the second embodiment, the HID ballast and lamp has three leads, X1*a*, X1*b* and X1*c*. Of the leads X1*a* and X1*b*, only one lead is connected to the ballast since the ballast has only two output leads. Selection of X1*a* or X1*b* is determined by the lamp type and wattage as indicated in FIGS. 4*b* and 4*c* of wiring diagrams for different lamp types and ballasts.

Again, as in the start cycle for the ballast for a non-igniter start, the start cycle for an igniter start lamp and ballast requires voltages to be present at tap X3 and either tap X1*a* or X1*b*. A small fraction of the open circuit voltage is introduced across the input to the BR1, the output of the BR1 serving to store a DC voltage in capacitor C1. As the relatively high amplitude open circuit of the ballast continues, the output of the BR1 continues to provide a DC voltage to capacitor C1 until the stored voltage level of capacitor C1 reaches the breakdown voltage of 32 volt diac. At this level, the 32 volt diac conducts. The LED momentarily flashes to indicate the relatively high amplitude of the open circuit voltage present of the ballast. The process continues, the LED continuing to flash to indicate the presence of the high amplitude open circuit voltage of the ballast, thus indicating a lamp failure and an operating ballast in conjunction with an operating igniter. If the lamp is out and the LED is not flashing, the failure of the lamp to illuminate could be caused by failure of the ballast or failure of the igniter or by failure of both the ballast and the igniter.

While particular embodiments of the invention have been shown and described, it will be understood that the invention is not limited thereto, as many modifications may be made and will become apparent to those skilled in the art.

What is claimed is:

1. A high intensity discharge (HID) lamp ballast and lamp tester connected to output side of said ballast and not requiring a specific line voltage for continuously monitoring the status of an HID lighting system comprising an HID lamp and ballast circuitry, providing a visual indicator of HID lamp and HID ballast failure, said ballast and lamp tester, in combination, comprising:

(a) an HID ballast including ballast circuitry providing an output of a relatively high amplitude open circuit voltage as a series of high voltage pulses to an HID lamp and a lower operating voltage to said HID lamp as a pulse AC power source and a lower operating voltage source;

(b) a voltage divider network of two resistors comprising a voltage dropping resistor and a load resistor to drop the voltage and provide a circuit load for said operating voltage of said ballast and said open circuit voltage of said ballast output;

(c) a full wave bridge rectifier circuit across said pulse AC power source to convert pulse AC power output voltage to provide a DC current power supply voltage to charge a filter capacitor as a series of DC voltage pulses;

(d) a trigger circuit comprising a bi-directional silicon switch diac in series connection with said filter capacitor;

(e) a light emitting diode (LED) in series connection with said trigger circuit, said bridge rectifier circuit, said voltage divider network and said HID ballast wherein said relatively high magnitude open circuit voltage over operating circuit voltage of said ballast of said ballast output present as an AC pulse voltage is rectified to a DC voltage to provide a charging voltage on said filter capacitor to overcome breakdown voltage of said diac and trigger illumination of said light emitting diode as a momentary flashing of light on discharge of said capacitor.

2. The high intensity discharge (HID) ballast and lamp tester of claim 1 wherein said relatively high magnitude open circuit voltage of said ballast output is present to provide a charging voltage on said filter capacitor sufficient to overcome breakdown voltage of said didac upon discharge of prior charge of capacitor to trigger illumination of said light emitting diode as a momentary flashing of light and provide a continuing flashing of light.

3. The high intensity discharge (HID) ballast and lamp tester of claim 1 wherein said high voltage to said HID lamp are provided by the ballast secondary coil in series connection with said ballast circuitry and said lamp.

4. The high intensity discharge (HID) ballast and lamp tester of claim 1 wherein said series of high voltage pulses to said HID lamp are provided by an igniter in parallel connection with said ballast circuitry and said lamp.

* * * * *

UNITED STATES PATENT AND TRADEMARK OFFICE

CERTIFICATE OF CORRECTION

PATENT NO. : 7,282,869 B1
APPLICATION NO. : 11/363362
DATED : October 16, 2007
INVENTOR(S) : Mayer et al.

It is certified that error appears in the above-identified patent and that said Letters Patent is hereby corrected as shown below:

Col. 8, line 23 should read:

--to overcome breakdown voltage of said diac upon...--

Signed and Sealed this

Eighteenth Day of December, 2007

JON W. DUDAS
*Director of the United States Patent and Trademark Office*